US007247071B2

(12) United States Patent
Fujisawa et al.

(10) Patent No.: US 7,247,071 B2
(45) Date of Patent: Jul. 24, 2007

(54) LIGHT SOURCE LAMP AND MANUFACTURING METHOD THEREOF, AND PROJECTOR

(75) Inventors: Shohei Fujisawa, Suwa (JP); Hiroyuki Kobayashi, Matsumoto (JP); Toru Terashima, Matsumoto (JP); Kazuhiro Tanaka, Matsumoto (JP); Takeshi Takezawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 152 days.

(21) Appl. No.: 11/082,869

(22) Filed: Mar. 18, 2005

(65) Prior Publication Data

US 2005/0218770 A1 Oct. 6, 2005

(30) Foreign Application Priority Data

Mar. 22, 2004 (JP) ..... 2004-082136
Jan. 11, 2005 (JP) ..... 2005-004331

(51) Int. Cl.
*H01J 9/00* (2006.01)

(52) U.S. Cl. ..... 445/22; 362/257; 362/341; 362/346; 362/296

(58) Field of Classification Search ..... 362/257, 362/296–298, 341, 346; 40/98, 99; 445/26, 445/27, 22, 43; 313/318.01, 318.12, 113, 313/114

See application file for complete search history.

(56) References Cited

U.S. PATENT DOCUMENTS 4,918,353 A * 4/1990 Nelson et al. ..... 313/113
5,491,525 A * 2/1996 Yamasaki et al. ..... 353/98

FOREIGN PATENT DOCUMENTS

| | | |
|---|---|---|
| JP | 08-031382 | 2/1996 |
| JP | 09-120067 | 5/1997 |

* cited by examiner

*Primary Examiner*—Sandra O'Shea
*Assistant Examiner*—Mark Tsidulko
(74) *Attorney, Agent, or Firm*—Oliff & Berridge, PLC

(57) ABSTRACT

To reduce or prevent adhesive particles from being scattered toward a light-emitting portion of an arc tube and an auxiliary reflecting surface of an auxiliary mirror even when an inorganic adhesive injected for fixing the auxiliary mirror to the arc tube is boiled, a method of manufacturing a light source lamp includes: setting a light-reflecting surface of the auxiliary mirror so as to face the light-emitting portion of the arc tube and injecting an adhesive into a gap between the auxiliary mirror and the arc tube; heating and curing the adhesive from a side nearer to the light-emitting portion of the arc tube; and attaching the reflector to the arc tube with the auxiliary mirror fixed thereto. For example, a heated air blowoff and light irradiation toward the adhesive form the side nearer to the light-emitting portion of the arc tube may be performed. Further, a projector includes: an illumination system with the light source lamp; an optical modulator; and a projector lens.

14 Claims, 8 Drawing Sheets

LIGHT SOURCE LAMP AND MANUFACTURING METHOD THEREOF, AND PROJECTOR

BACKGROUND

Exemplary aspects of the present invention relate to a light source lamp having a reflector and an auxiliary mirror and its manufacturing method, and a projector with the light source lamp.

FIG. 7 is a schematic showing a configuration of a light source lamp placed in a light source lamp unit of a related art projector or the like. In FIG. 7, the light source lamp 9 has an arc tube 10, a reflector 20, and an auxiliary mirror 40. The arc tube 10 has a bulging light-emitting portion 11 in its central portion and columnar portions 13*a*, 13*b* extending on both sides of the light-emitting portion 11 (hereinafter sealing portions). The reflector 20 serves to emit the light radiated by the arc tube 10 and the light reflected by the auxiliary mirror 40 ahead of it (i.e. in the right direction in the drawing).

The auxiliary mirror 40 is attached facing the reflector 20 and serves to reflect the light radiated by the arc tube 10 toward the reflector 20. The auxiliary mirror 40 includes; a spherical surface or concave surface (hereinafter auxiliary reflecting surface), such as an aspheric surface 41; a generally cone-like portion 42 (hereinafter body portion) forming the auxiliary reflecting surface 41; and a center bore 44 piercing the center of rotation of the auxiliary reflecting surface 41.

One sealing portion 13*b* of the arc tube 10 is inserted in the center bore 44 of the auxiliary mirror 40, followed by regulating the auxiliary mirror 40 and the arc tube 10 in position. In this condition, an inorganic adhesive (i.e. cement) 59 is injected into a gap 52 between the inner periphery of the center bore 44 and the outer periphery of the sealing portion 13*b* (hereinafter reflecting surface gap) thereby to adhesively fix the auxiliary mirror 40 and the arc tube 10 (see p. 2 and FIG. 1 of JP-A-8-31382, for example).

SUMMARY

FIG. 8 is a schematic showing how to fix an auxiliary mirror in a light source lamp placed in a light source lamp unit of a related projector or the like. In FIG. 8, the auxiliary reflecting surface 41 of the auxiliary mirror 40 is disposed facing the light-emitting portion 11 of the arc tube 10. In addition, the inorganic adhesive 59 is injected into the reflecting surface gap 52 and the inorganic adhesive 59 is irradiated with thermic rays 80.

In this step, the thermic rays 80 are applied by a halogen lamp 81 from the side opposite to the auxiliary reflecting surface 41 of the auxiliary mirror 40 (so-called open side thereof). As a result, when the inorganic adhesive 59 is heated and cured, vapor and boiled adhesive particles are scattered toward the light-emitting portion 11 of the arc tube 10, the auxiliary reflecting surface 41 of the auxiliary mirror 40, etc. This poses the problem that the adhesion of scattered adhesive particles to the arc tube 10 and the auxiliary mirror 40 lowers the light emission efficiency of the arc tube 10 and the reflection efficiency of the auxiliary mirror 40.

Exemplary aspects of the invention were made in consideration of the above and/or other problems. Exemplary aspects of the invention provide a light source lamp and its manufacturing method and a projector with such a light source lamp. The invention can avoid the scatter of the adhesive particles toward the light-emitting portion of the arc tube and the auxiliary reflecting surface of the auxiliary mirror even when the inorganic adhesive injected for the purpose of fixing the auxiliary mirror to the arc tube is boiling.

The light source lamp manufacturing method of an exemplary aspect of the invention is a method of manufacturing a light source lamp having an arc tube including a light-emitting portion and a pair of sealing portions extending on both sides of the light-emitting portion, a reflector fixed to one sealing portion to reflect an emission light emitted from the light-emitting portion, and an auxiliary mirror fixed to the other sealing portion to reflect an emission light emitted from the light-emitting portion toward the reflector. The method includes: an adhesive injection step to set a light-reflecting surface of the auxiliary mirror so as to face the light-emitting portion and injecting an adhesive into a gap between the auxiliary mirror and the other sealing portion; a heating and curing step to heat and cure the adhesive from a side nearer to the light-emitting portion of the arc tube; and an assembling step to attach the reflector to the arc tube with the auxiliary mirror fixed thereto.

The adhesive injected into the gap between the auxiliary mirror and the arc tube is heated from the side nearer to the light-emitting portion and begins to be cured from the side nearer to the light-emitting portion. Consequently, an end of the gap nearer to the light-emitting portion is to be sealed by the cured adhesive early in the heating. Therefore, even when the water contained in the adhesive is evaporated or the adhesive is boiled, the vapor and adhesive particles are scattered in an unsealing direction opposite to the light-emitting portion. Hence, the adhesive particles never adhere to the light-emitting portion of the arc tube and the auxiliary reflecting surface of the auxiliary mirror. Therefore, a high-quality light source lamp assured in the light emission efficiency of the arc tube and the reflection efficiency of the auxiliary mirror can be obtained.

It is preferable that the method of manufacturing a light source lamp is characterized in the heating and curing step includes blowing off a heated air against the adhesive from the side nearer to the light-emitting portion of the arc tube.

The adhesive injected into the gap between the auxiliary mirror and the arc tube is surely heated from the side nearer to the light-emitting portion of the arc tube. Thus, the curing of the adhesive is pursued from the side nearer to the light-emitting portion. Therefore an end of the gap nearer to the light-emitting portion is sealed by the cured adhesive early in the heating. Hence, even when the water contained in the adhesive is evaporated or the adhesive is boiled, the vapor and adhesive particles are scattered in a direction opposite to the light-emitting portion.

Also, it is preferable that the method of manufacturing a light source lamp is characterized in the heating and curing step includes irradiating the adhesive with a light from the side nearer to the light-emitting portion of the arc tube.

The adhesive injected into the gap between the auxiliary mirror and the arc tube is surely heated from the side nearer to the light-emitting portion of the arc tube. Thus, the curing of the adhesive is pursued from the side nearer to the light-emitting portion and therefore an end of the gap nearer to the light-emitting portion is sealed by the cured adhesive early in the heating. Hence, even when the water contained in the adhesive is evaporated or the adhesive is boiled, the vapor and adhesive particles are scattered in a direction opposite to the light-emitting portion.

Further, the light source lamp manufacturing method of an exemplary aspect of the invention is a method of manufacturing a light source lamp having an arc tube including a light-emitting portion and a pair of sealing portions extending on both sides of the light-emitting portion, and a reflector fixed to one sealing portion to reflect an emission light emitted from the light-emitting portion. The method includes: a second adhesive injection step to inject an adhesive into a gap between the one sealing portion and the reflector; and a second heating and curing step to heat and cure the adhesive from a side nearer to the light-emitting portion of the arc tube.

The adhesive injected into the gap between the reflector and the arc tube is heated from the side nearer to the light-emitting portion and begins to be cured from the side nearer to the light-emitting portion. Consequently, an end of the gap nearer to the light-emitting portion is to be sealed by the cured adhesive early in the heating. Therefore, even when the water contained in the adhesive is evaporated or the adhesive is boiled, the vapor and adhesive particles are scattered in an unsealing direction opposite to the light-emitting portion. Hence, the adhesive particles never adhere to the light-emitting portion of the arc tube and the reflecting surface of the reflector. Therefore, a high-quality light source lamp assured in the light emission efficiency of the arc tube and the reflection efficiency of the reflector can be obtained.

It is preferable that the method of manufacturing a light source lamp is characterized in the second heating and curing step includes blowing off a heated air against the adhesive from the side nearer to the light-emitting portion of the arc tube.

The adhesive injected into the gap between the reflector and the arc tube is surely heated from the side nearer to the light-emitting portion of the arc tube. Thus, the curing of the adhesive is pursued from the side nearer to the light-emitting portion and therefore an end of the gap nearer to the light-emitting portion is sealed by the cured adhesive early in the heating. Hence, even when the water contained in the adhesive is evaporated or the adhesive is boiled, the vapor and adhesive particles are scattered in a direction opposite to the reflecting surface of the reflector.

It is preferable that the method of manufacturing a light source lamp is characterized in the second heating and curing step includes heating and curing at least a portion of the adhesive nearer to the light-emitting portion of the arc tube from the side nearer to the light-emitting portion, and heating and curing the remaining portion of the adhesive from a side opposite to the side nearer to the light-emitting portion.

The adhesive injected into the gap between the reflector and the arc tube is surely heated from the side nearer to the light-emitting portion of the arc tube. Thus, the curing of the adhesive is pursued from the side nearer to the light-emitting portion. Therefore an end of the gap nearer to the light-emitting portion is sealed by the cured adhesive early in the heating. Hence, even when the water contained in the adhesive is evaporated or the adhesive is boiled, the vapor and adhesive particles are scattered in a direction opposite to the reflecting surface of the reflector. In addition, the uncured adhesive on a side opposite to the side nearer to the light-emitting portion of the arc tube is heated from the side opposite to the side nearer to the light-emitting portion and as such, the curing is pursued. Therefore, a high-quality light source lamp assured in the light emission efficiency of the arc tube and the reflection efficiency of the reflector can be obtained readily.

Further, a light source lamp of an exemplary aspect of the invention is characterized by including: an arc tube including a light-emitting portion and a pair of sealing portions extending on both sides of the light-emitting portion; a reflector fixed to one sealing portion to reflect an emission light emitted from the light-emitting portion; and an auxiliary mirror fixed to the other sealing portion and having a light-reflecting surface to reflect an emission light emitted from the light-emitting portion toward the reflector.

The auxiliary mirror is fixed to the other sealing portion by setting the light-reflecting surface so as to face the light-emitting portion, injecting an adhesive into a gap between the auxiliary mirror and the other sealing portion, and heating and curing the adhesive from the side nearer to the light-emitting portion of the arc tube.

The adhesive injected into the gap between the auxiliary mirror and the arc tube is heated from the side nearer to the light-emitting portion and begins to be cured from the side nearer to the light-emitting portion. Consequently, an end of the gap nearer to the light-emitting portion is to be sealed early in the heating. Therefore, even when the water contained in the adhesive is evaporated or the adhesive is boiled, the vapor and adhesive particles are scattered in an unsealing direction opposite to the light-emitting portion. Hence, the adhesive particles never adhere to the light-emitting portion of the arc tube and the auxiliary reflecting surface of the auxiliary mirror. Therefore, the light source lamp is maintained in a high quality condition in the light emission efficiency of the arc tube and the reflection efficiency of the auxiliary mirror.

Also, it is preferable that the light source lamp is characterized in that the auxiliary mirror includes a body portion having a light-reflecting surface, and a fixing neck portion adjacent to the body portion and used to fix the auxiliary mirror to the arc tube.

The arc tube can be partially inserted in the fixing neck portion of a given length to fix the auxiliary mirror to the arc tube and as such, the operation to attach the auxiliary mirror is made more stable, and the adhering area of the adhesive is enlarged. As a result, the accuracy and strength of the fixing of the auxiliary mirror to the arc tube are assured. In addition, since the adhesive injected into the gap between the fixing neck portion and the arc tube begins to be cured from the side nearer to the light-emitting portion, the vapor and the adhesive particles never adhere to the light-emitting portion of the arc tube and the auxiliary reflecting surface of the auxiliary mirror like the foregoing lamp. Hence, with the light source lamp, the accuracy and strength of the fixing, and light-emitting performance are assured.

Further, a light source lamp of an exemplary aspect of the invention is characterized by including: an arc tube including a light-emitting portion and a pair of sealing portions extending on both sides of the light-emitting portion; and a reflector fixed to one sealing portion to reflect an emission light emitted from the light-emitting portion.

The reflector is fixed to the one sealing portion by injecting an adhesive into a gap between the reflector and the one sealing portion, and heating and curing the adhesive from a side nearer to the light-emitting portion of the arc tube.

According to this, the adhesive injected into the gap between the reflector and the arc tube is heated from the side nearer to the light-emitting portion and begins to be cured from the side nearer to the light-emitting portion. Consequently, an end of the gap nearer to the light-emitting portion is sealed by the so cured adhesive early in the heating. Therefore, even when the water contained in the adhesive is evaporated or the adhesive is boiled, the vapor and adhesive particles are scattered in an unsealing direction opposite to the light-emitting portion. Hence, the adhesive particles never adhere to the light-emitting portion of the arc tube and the reflecting surface of the reflector. Therefore, such light source lamp is of high quality because the light emission efficiency of the arc tube and the reflection efficiency of the auxiliary mirror are assured.

The light source lamp may be characterized by further including an auxiliary mirror fixed to the other sealing portion of the pair of sealing portions and having a light-reflecting surface to reflect an emission light emitted from the light-emitting portion toward the reflector, The auxiliary mirror is fixed to the other sealing portion by setting the light-reflecting surface so as to face the light-emitting portion, injecting an adhesive into a gap between the auxiliary mirror and the other sealing portion, and heating and curing the adhesive from the side nearer to the light-emitting portion of the arc tube.

According to this, the adhesive injected into the gap between the auxiliary mirror and the arc tube is heated from the side nearer to the light-emitting portion and begins to be cured from the side nearer to the light-emitting portion. Consequently, an end of the gap nearer to the light-emitting portion is sealed by the so cured adhesive early in the heating. Therefore, even when the water contained in the adhesive is evaporated or the adhesive is boiled, the vapor and adhesive particles are scattered in an unsealing direction opposite to the light-emitting portion. Hence, the adhesive particles never adhere to the light-emitting portion of the arc tube and the auxiliary reflecting surface of the auxiliary mirror. Therefore, such a light source lamp is of high quality because the light emission efficiency of the arc tube and the reflection efficiency of the auxiliary mirror are assured.

Still further, a projector of an exemplary aspect of the invention is characterized by including: an illumination system including any one of the light source lamps; an optical modulator to produce an image by modulating a light emitted from the illumination system according to image information; and a projector lens to project the image.

According to this, an increase in brightness of the a projected image and uniform illumination of the projector with the light source lamp placed therein are ensured, which makes it possible to provide comfortable image conditions. This is because the light-emitting portion of the arc tube and the auxiliary reflecting surface of the auxiliary mirror, which constitute the light source lamp, are kept clean.

DETAILED DESCRIPTION OF EXEMPLARY EMBODIMENTS

Figure 1:
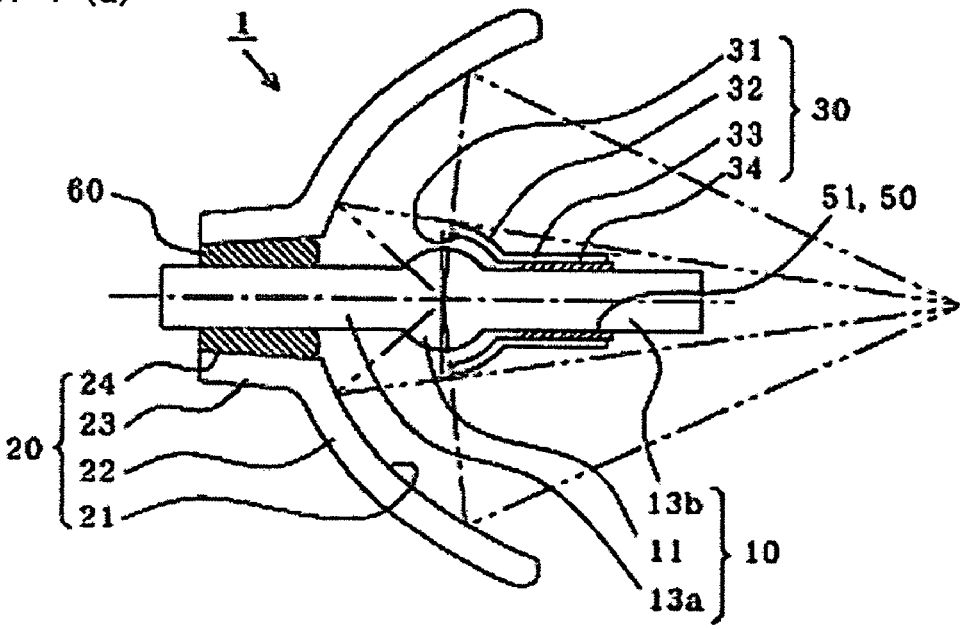
FIGS. 1(*a*)-1(*c*) are schematics showing a configuration of light a source lamp according to the first exemplary embodiment of the invention.
Figure 1:
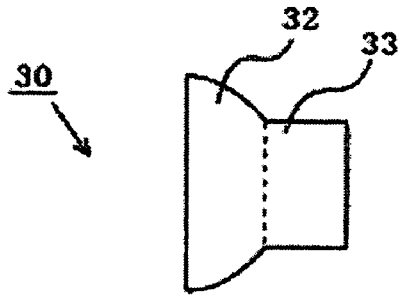
Figure 1:
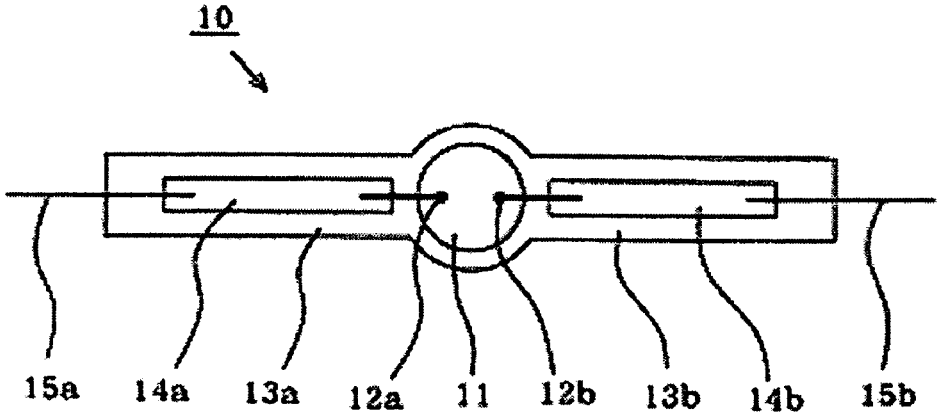

A light source lamp as the first exemplary embodiment of the invention, a method of manufacturing the light source lamp as the second exemplary embodiment, and a projector as the third exemplary embodiment will now be described with reference to the drawings. In the drawings, like or corresponding parts are identified by the same reference character and the description of part of them is omitted.

First Exemplary Embodiment

First Example of Light Source Lamp

The configuration of a light source lamp according to the first exemplary embodiment of the invention is shown in FIGS. 1(*a*)-1(*c*). Of the drawings, FIG. 1(*a*) is a schematic of the light source lamp, FIG. 1(*b*) is a schematic of an auxiliary mirror of the lamp, and FIG. 1(*c*) is a schematic of an arc tube of the lamp. As shown in FIGS. 1(*a*)-1(*c*), the light source lamp 1 includes an arc tube 10, a reflector 20, and an auxiliary mirror 30.

The arc tube 10 is, for example, a mercury lamp, which is formed from quartz glass, etc. The arc tube 10 has a light-emitting portion 11 in its center and sealing portions 13*a*, 13*b* provided extending on both sides of the light-emitting portion 11. In the light-emitting portion 11, mercury, rare gas, a small amount of halogen, etc. are sealed and electrodes 12*a*, 12*b* formed from tungsten are disposed. In the sealing portions 13*a*, 13*b*, metal foils 14*a*, 14*b* formed from molybdenum are connected to the electrodes 12*a*, 12*b* and sealed. The metal foils 14*a*, 14*b* are respectively provided with lead wires 15*a*, 15*b* leading to the outside. The arc tube 10 is not limited to a mercury lamp, and it may be a metal halide lamp, a xenon lamp, or the like.

The reflector 20 is a reflecting element in the illumination system, which is fixed to one sealing portion 13*a* of the arc tube 10. The reflector 20 includes: a concave surface 21 (hereinafter reflecting surface), such as an aspheric surface or a spherical surface; a generally cone-like portion 22 (hereinafter cup portion) forming the reflecting surface 21; a cylindrical portion 23 (hereinafter neck portion) provided extending from a center of the cup portion 22 on a side opposite to the side of the reflecting surface 21 (i.e. on the side of the convex surface); and a center hole 24 coaxial with the center of rotation of the reflecting surface 21, the hole piercing the neck portion 23. The cup portion 22 and neck portion 23 are integrally formed from a heat-resistant glass (e.g. silica tube) into a funnel shape.

Then, the one sealing portion 13*a* of the arc tube 10 is inserted into the center hole 24 of the reflector 20. An inorganic adhesive 60 is injected into the gap between the outer periphery of the sealing portion 13*a* and the inner periphery of the center hole 24 and cured.

The auxiliary mirror 30 serves to reflect an emission light of the arc tube 10 toward the reflector 20. The auxiliary mirror 30 includes: a concave surface 31 (hereinafter auxiliary reflecting surface), such as an aspheric surface or a spherical surface; a generally cone-like portion 32 forming the auxiliary reflecting surface 31 (hereinafter body portion); a cylindrical portion 33 (hereinafter fixing neck portion) provided extending from a center of the body portion 32 on a side opposite to the side of the auxiliary reflecting surface 31 (i.e. on the side of the convex surface); and a center bore 34 coaxial with the center of rotation of the auxiliary reflecting surface 31, the bore piercing the fixing neck portion 33. Moreover, the body portion 32 and fixing neck portion 33 are integrally formed from a heat-resistant glass (e.g. silica tube) into a funnel shape. An inorganic adhesive 50 is injected into a gap 51 (hereinafter neck portion gap) between the inner periphery of the center bore 34 and the outer periphery of the sealing portion 13*b*, whereby the auxiliary mirror 30 is fixed to the arc tube 10.

The auxiliary mirror 30 is fixed to the arc tube 10 by inserting the sealing portion 13*b* into the center bore 34 of the fixing neck portion 33 having a predetermined length, injecting the inorganic adhesive 50 into the neck portion gap 51, and heating the inorganic adhesive 50 from the side nearer to the light-emitting portion 11 (i.e. the side nearer to the sealing portion 13*a*) thereby to cure the adhesive. This allows the light-emitting portion 11 of the arc tube 10 and the auxiliary reflecting surface 31 of the auxiliary mirror 30 to be kept clean, thereby assuring the light emission efficiency of the arc tube 10 and the reflection efficiency of the auxiliary mirror 30. Consequently, an increased brightness of the light source lamp 1 and uniform illumination are ensured. (The detailed description about this is made separately.)

Second Example of Light Source Lamp

Figure 2:
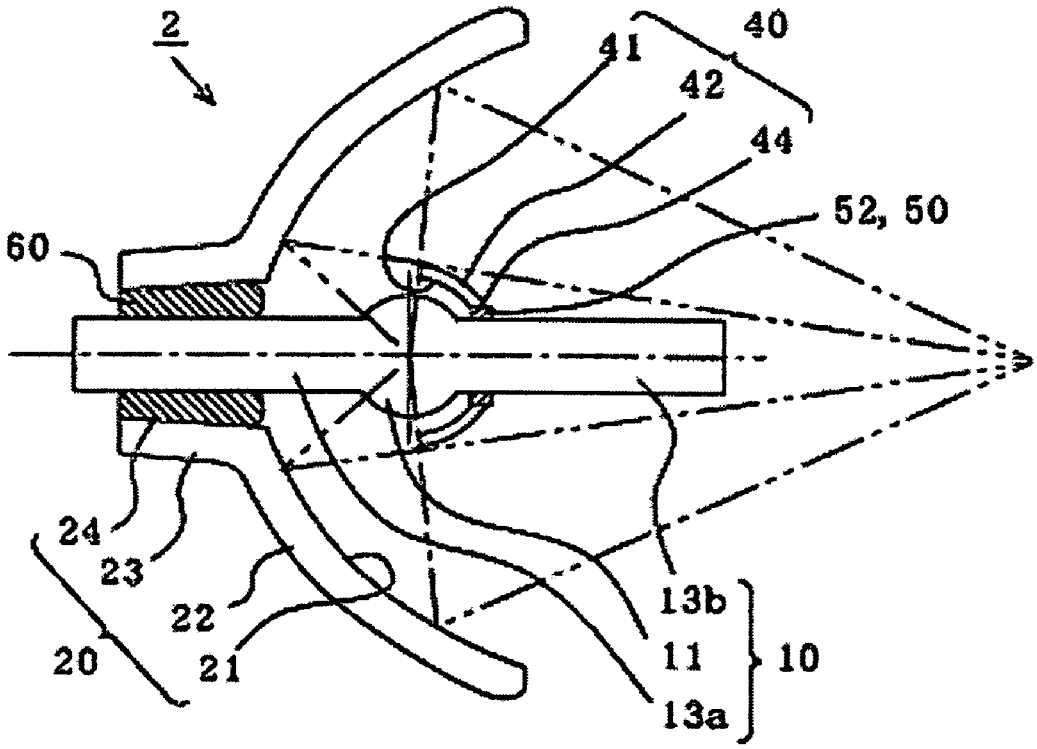
FIG. 2 is a schematic showing another configuration of the light source lamp according to the first exemplary embodiment of the invention.

FIG. 2 is a schematic showing another configuration of the light source lamp according to the first exemplary embodiment of the invention. As shown in FIG. 2, the light source lamp 2 includes an arc tube 10, a reflector 20, and an auxiliary mirror 40. The auxiliary mirror 40 includes an auxiliary reflecting surface 41, a body portion 42, and a center bore 44 without a neck portion. One of the sealing portions, 13*b*, of the arc tube 10 is inserted in the center bore 44 of the auxiliary mirror 40, followed by regulating the auxiliary mirror 40 and the arc tube 10 in position. In this condition, an inorganic adhesive (i.e. cement) 50 is injected into a gap 52 between the inner periphery of the center bore 44 and the outer periphery of the sealing portion 13*b* thereby to adhesively fix the auxiliary mirror 40 and the arc tube 10.

The auxiliary mirror 40 is fixed to the arc tube 10 by injecting the inorganic adhesive 50 into the reflecting surface gap 52, and heating the inorganic adhesive 50 from the side nearer to the light-emitting portion 11 (i.e. the side nearer to the sealing portion 13*a*) thereby to cure the adhesive. This allows the light-emitting portion 11 of the arc tube 10 and the auxiliary reflecting surface 41 of the auxiliary mirror 40 to be kept clean, thereby assuring the light emission efficiency of the arc tube 10 and the reflection efficiency of the auxiliary mirror 40. Consequently, an increased brightness of the light source lamp 1 and uniform illumination are ensured. (The detailed description about this is to be made separately.)

Figure 7:
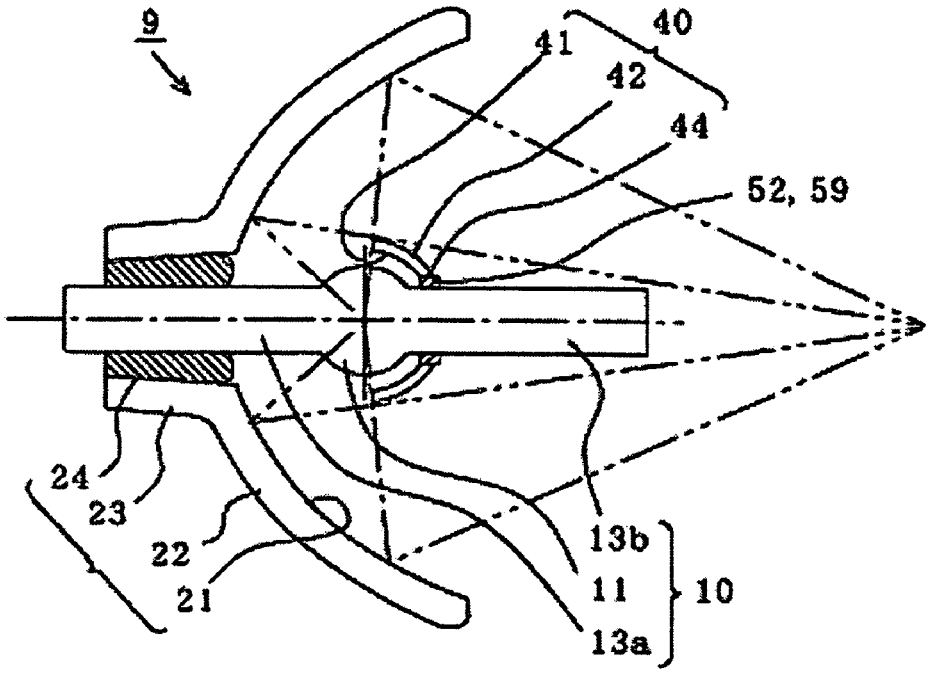
FIG. 7 is a schematic showing a configuration of a conventional light source lamp.
Figure 8:
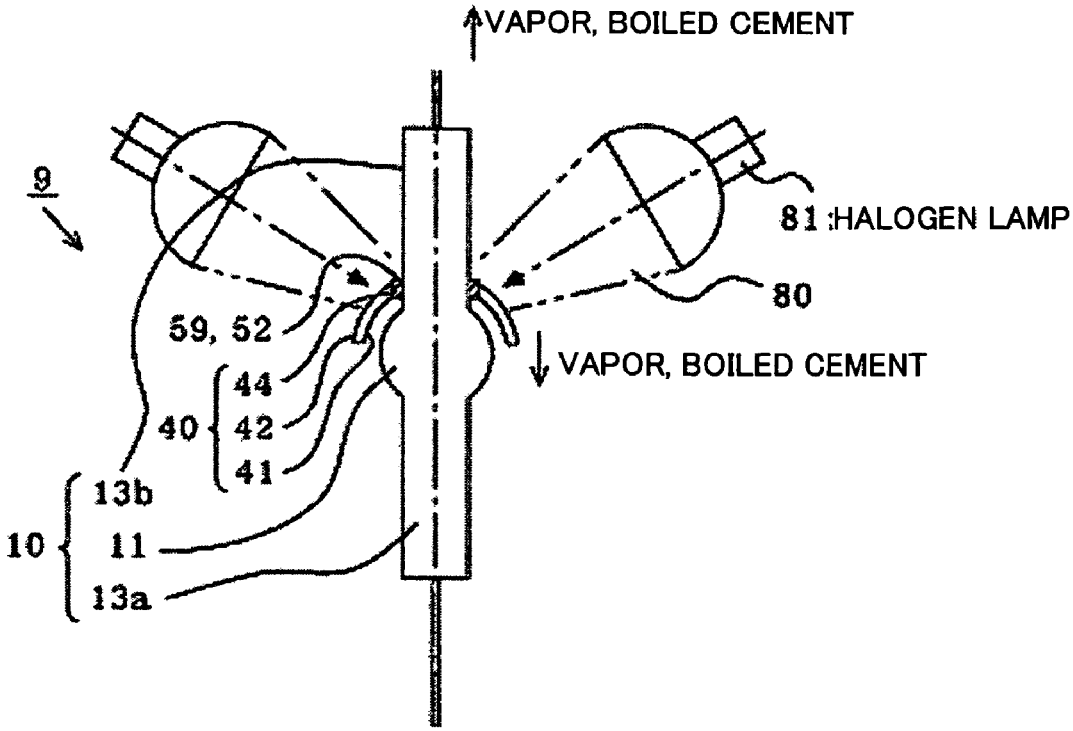
FIG. 8 is a schematic showing a method of fixing an auxiliary mirror in the related art light source lamp.

While the inorganic adhesive 50 for the light source lamp 2 and the inorganic adhesive 59 of the related art light source lamp 9 (see FIG. 7) are identified respectively by different characters for convenience of description, these adhesives may be of the same material.

Second Exemplary Embodiment

First Example of Light Source Lamp Manufacturing Method

Figure 3:
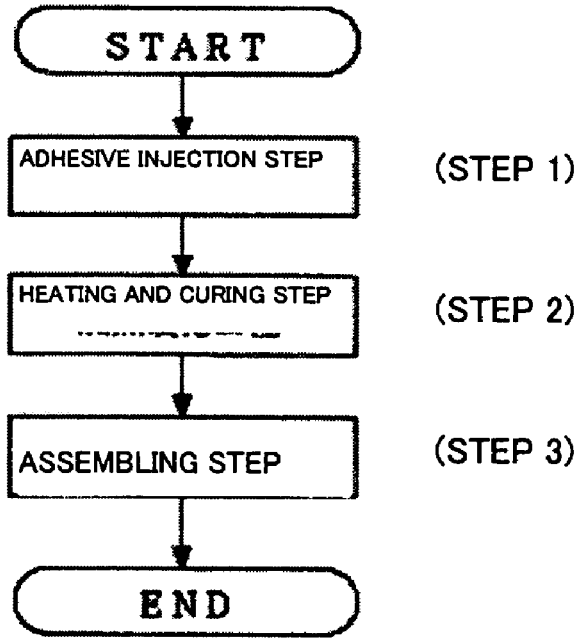
FIG. 3 is a flow diagram showing a light source lamp manufacturing method according to the second exemplary embodiment of the invention.
Figure 4:
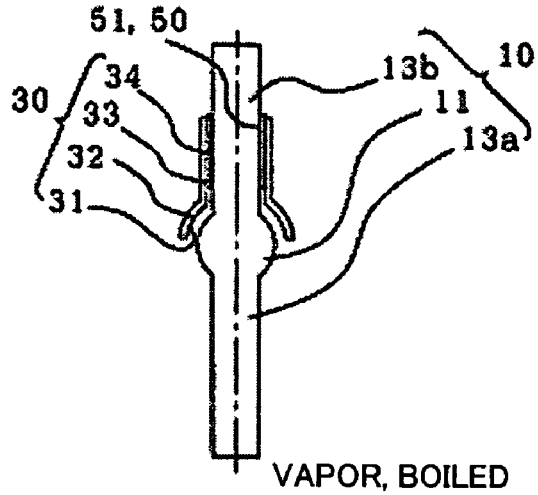
FIGS. 4(*a*)-4(*c*) are schematics showing an example of the light source lamp manufacturing method according to the second exemplary embodiment of the invention.
Figure 4:
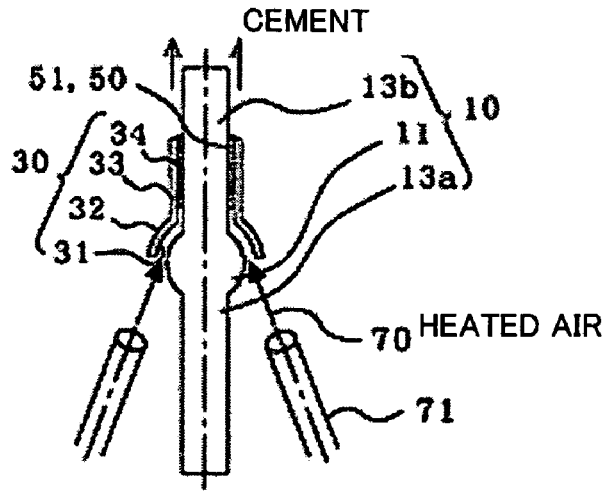
Figure 4:
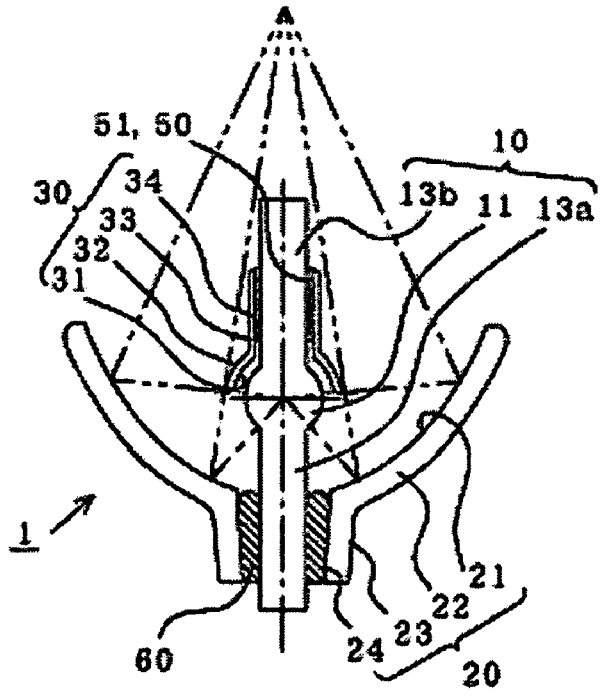

A light source lamp manufacturing method according to the second exemplary embodiment of the invention will be shown in reference to FIGS. 3 and 4(*a*)-4(*c*). Of those drawings, FIG. 3 is a flow diagram, and FIGS. 4(*a*)-4(*c*) are relevant schematics. In FIGS. 3 and 4(*a*)-4(*c*), the light source lamp manufacturing method includes: injecting the inorganic adhesive 50 into the neck portion gap 51 with the auxiliary reflecting surface 31 of the auxiliary mirror 30 facing the light-emitting portion 11 of the arc tube 10 (Step 1 in FIG. 3, see FIG. 4(*a*)); blowing off a heated air 70 against the injected inorganic adhesive 50 from the side nearer to the light-emitting portion 11 (i.e. the side nearer to the sealing portion 13*a*) (Step 2 in FIG. 3, see FIG. 4(*b*)); and attaching the reflector 20 to the arc tube 10 with the auxiliary mirror 30 fixed thereto (Step 3 in FIG. 3, see FIG. 4(*c*)).

In the method, the inorganic adhesive 50 injected into the neck portion gap 51 is heated from the side nearer to the light-emitting portion 11 (i.e. the side nearer to the sealing portion 13*a*) and begins to be cured from a location near to the light-emitting portion 11. Consequently, an end of the neck portion gap 51 nearer to the light-emitting portion 11 is to be sealed early in the heating. Therefore, even when the water contained in the inorganic adhesive 50 is evaporated or the adhesive components are vaporized, the vapor and adhesive particles are scattered in a direction opposite to the light-emitting portion 11 (i.e. a direction outwardly from the unsealed end of the neck portion gap 51).

Hence, the light-emitting portion 11 of the arc tube 10 and the auxiliary reflecting surface 31 of the auxiliary mirror 30 can be kept clean with no adhesive particles adhering to them. On this account, a light source lamp 1 including them can maintain a high light emission efficiency of the arc tube 10 and a high reflection efficiency of the auxiliary mirror 30, which assures high brightness and uniformity of the emission light.

While in FIGS. 4(*a*)-(*c*) the auxiliary reflecting surface 31 of the auxiliary mirror 30 is oriented vertically downward and the heated air 70 is blown off upward from the downside, the invention is not so limited. The auxiliary reflecting surface 31 may be oriented in any direction (e.g. vertically upward, obliquely upward or obliquely downward, or horizontally sideways).

Specifically, the inorganic adhesive 50 is heated from the side nearer to the light-emitting portion 11 and the end of the neck portion gap 51 nearer to the light-emitting portion 11 is sealed early in the heating and as such, neither vapor nor adhesive particles are scattered onto the light-emitting portion 11 regardless of the position of the auxiliary reflecting surface 31. In addition, the air nozzle 71 to blow off the heated air 70 is not limited in its number and the form for the blowoff (e.g. whether that is a fixed nozzle or swing nozzle).

Also, the adhesive injection and assembling are not limited to the particular modes (in the arrangement of the reflector 20, and the injection, drying and curing of the inorganic adhesive 60). Further, the material of the inorganic adhesive 50, 60 is not limited. For example, such adhesive may be a silica- or alumina-containing adhesive. Specifically, SUMICERAM manufactured by Asahi Chemical Co., Ltd. may be used for such adhesive (SUMICERAM: a registered trade name of Sumitomo Chemical Co., Ltd.).

Second Example of Light Source Lamp Manufacturing Method

Figure 5:
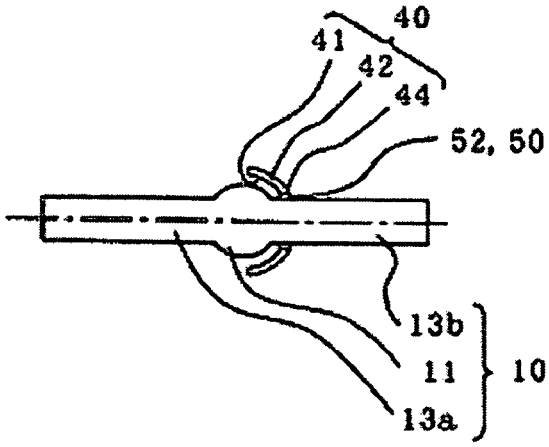
FIGS. 5(*a*)-5(*c*) are schematics showing another example of the light source lamp manufacturing method according to the second exemplary embodiment of the invention.
Figure 5:
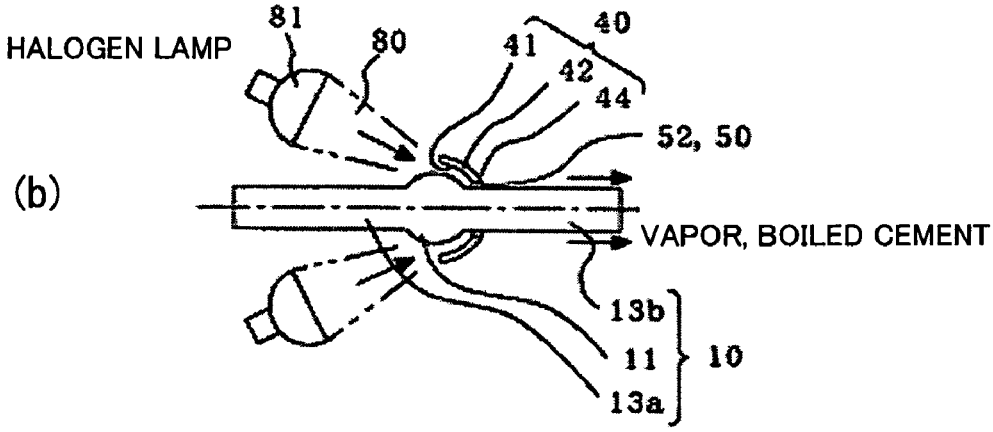
Figure 5:
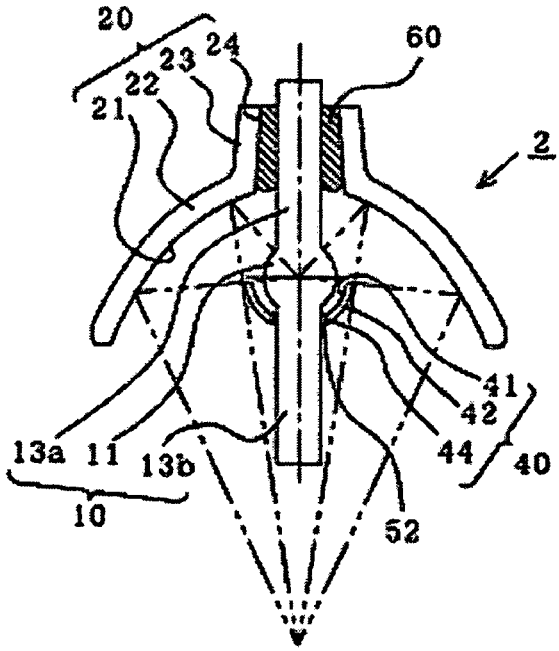

FIGS. 5(*a*)-5(*c*) are schematics showing another example of the light source lamp manufacturing method according to the second exemplary embodiment of the invention. In FIGS. 5(*a*)-5(*c*), the heated air 70 shown in FIG. 4 is replaced with thermic rays 80, and the light source lamp 1 is replaced with a light source lamp 2 with no fixing neck portion (see FIG. 2). Therefore, the descriptions for common parts in these lamps are omitted here.

The inorganic adhesive (i.e. cement) 50 is injected into the gap 52 (i.e. reflecting surface gap 52) between the center bore 44 of the auxiliary mirror 40 and the outer periphery of the sealing portion 13*b* of the arc tube 10 (FIG. 5(*a*)). Then, light 80 (hereinafter thermic rays) is applied to the inorganic adhesive 50 from the side nearer to the light-emitting portion 11 of the arc tube 10, whereby the auxiliary mirror 40 is fixed (FIG. 5(*b*)). After that, the reflector 20 is attached (FIG. 5(*c*)).

Consequently, an end of the reflecting surface gap 52 nearer to the light-emitting portion 11 is to be sealed early in the heating because the inorganic adhesive 50 begins to be cured from a location near to the light-emitting portion 11. Therefore, even when the water contained in the inorganic adhesive 50 is evaporated or the adhesive components are vaporized, the vapor and adhesive particles are scattered in a direction opposite to the light-emitting portion 11 (i.e. a direction outwardly from the unsealed end of the reflecting surface gap 52).

Hence, the light-emitting portion 11 of the arc tube 10 and the auxiliary reflecting surface 41 of the auxiliary mirror 40 can be kept clean with no adhesive particles adhering to them. On this account, a light source lamp 2 including them can maintain a high light emission efficiency of the arc tube 10 and a high reflection efficiency of the auxiliary mirror 40, which assures high brightness and uniformity of the emission light.

In the drawings, thermic rays 80 come from the halogen lamp 81. However, the invention is not so limited. For thermic rays 80, visible light or infrared light having a heating function may be used and its irradiation means may be arbitrary.

Third Example of Light Source Lamp Manufacturing Method

Figure 9:
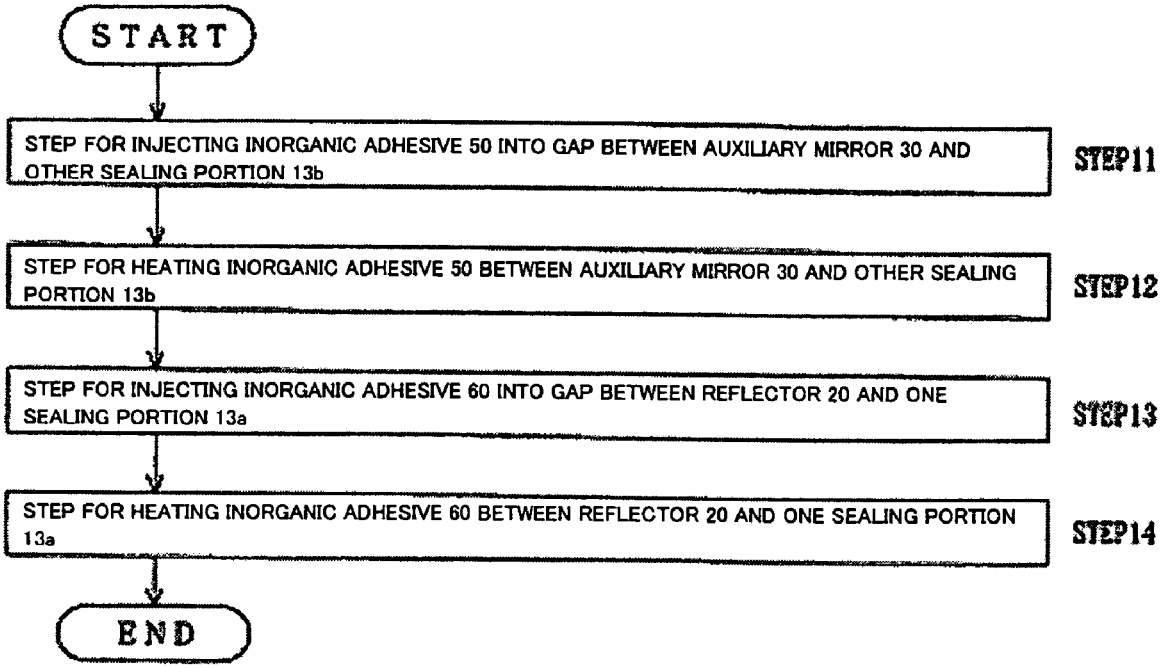
FIG. 9 is a flow diagram showing another example of the light source lamp manufacturing method according to the second exemplary embodiment of the invention.

FIG. 9 is a flow diagram showing another example of the light source lamp manufacturing method according to the second exemplary embodiment of the invention. The third example of the light source lamp manufacturing method is the same as the first and second examples in the attachment of the auxiliary mirror 30, specifically in that the adhesive 50 injected into the gap 51 between the auxiliary mirror 30 and arc tube 10 is heated from the side nearer to the light-emitting portion 11 and cured. However, the third example of the light source lamp manufacturing method differs from the first and second examples in that the adhesive 60 injected into the gap between one sealing portion 13*a* of the arc tube 10 and reflector 20 is heated from the side nearer to the light-emitting portion 11 and cured in fixing the reflector 20 to the arc tube 10.

The third example of the light source lamp manufacturing method includes: injecting an inorganic adhesive 50 into a space between the auxiliary mirror 30 and the other sealing portion 13*b* (Step 11 in FIG. 9); heating the inorganic adhesive 50 injected into the space between the auxiliary mirror 30 and the other sealing portion 13*b* (Step 12 in FIG. 9); injecting an inorganic adhesive 60 into a space between the reflector 20 and one sealing portion 13*a* (hereinafter adhesive injection step, Step 13 in FIG. 9); and heating the inorganic adhesive 60 injected into the space between the reflector 20 and the one sealing portion 13*a* from the side nearer to the light-emitting portion 11 (hereinafter heating and curing step, Step 14 in FIG. 9).

This can reduce or prevent the erosion of the reflecting surface 21 owing to the attachment of the contamination and the like resulting from the scatter of the inorganic adhesive 60 onto the reflecting surface 21 of the reflector 20 as with the first and second examples of the light source lamp manufacturing method.

In the heating and curing step for the inorganic adhesive 60 (Step 14), at least a portion of the inorganic adhesive 60 nearer to the light-emitting portion 11 may be cured first. In regard to the remaining portion of the inorganic adhesive 60, other than the portion nearer to the light-emitting portion 11, the following can be adopted to cure the inorganic adhesive 60:

(i) blowing off a heated air 700 against the inorganic adhesive 60 from the side nearer to the light-emitting portion 11;

(ii) irradiating the inorganic adhesive 60 from the side nearer to the light-emitting portion 11 with light of a halogen lamp;

(iii) performing in parallel or in series the operations of (1) blowing off the heated air 700 against the inorganic adhesive 60 from the side nearer to the light-emitting portion 11 and (2) turning on the halogen lamp directed toward the inorganic adhesive 60 from the side nearer to the light-emitting portion 11;

(iv) (1) blowing off the heated air 700 against the inorganic adhesive 60 from the side nearer to the light-emitting portion 11 thereby to cure a surface of the inorganic adhesive 60 at least on the side of the reflecting surface 21, and (2) irradiating the inorganic adhesive 60 by the halogen lamp from the side opposite to the side nearer to the light-emitting portion 11 (i.e. the backside of the reflecting surface 21) to completely cure the inorganic adhesive 60 after the surface of the inorganic adhesive 60 nearer to the reflecting surface 21 has been cured;

(v) (1) turning on the halogen lamp directed toward the inorganic adhesive 60 from the side nearer to the light-emitting portion 11 thereby to cure a surface of the inorganic adhesive 60 at least on the side of the reflecting surface 21, and (2) irradiating the inorganic adhesive 60 by the halogen lamp from the side opposite to the side nearer to the light-emitting portion 11 (i.e. the backside of the reflecting surface 21) to completely cure the inorganic adhesive 60 after the surface of the inorganic adhesive 60 nearer to the reflecting surface 21 has been cured;

(vi) (1) blowing off the heated air 700 against the inorganic adhesive 60 from the side nearer to the light-emitting portion 11 thereby to cure a surface of the inorganic adhesive 60 at least on the side of the reflecting surface 21, and (2) turning on the arc tube 10 thereby to completely cure the inorganic adhesive 60 after the surface of the inorganic adhesive 60 nearer to the reflecting surface 21 has been cured; and (vii) performing in parallel the operations of (1) blowing off the heated air 700 against the inorganic adhesive 60 from the side nearer to the light-emitting portion 11 and (2) turning on the arc tube 10 directed toward the inorganic adhesive 60 from the side nearer to the light-emitting portion 11 so that a surface of the inorganic adhesive 60 nearer to the reflecting surface 21 is cured first.

Figure 10:
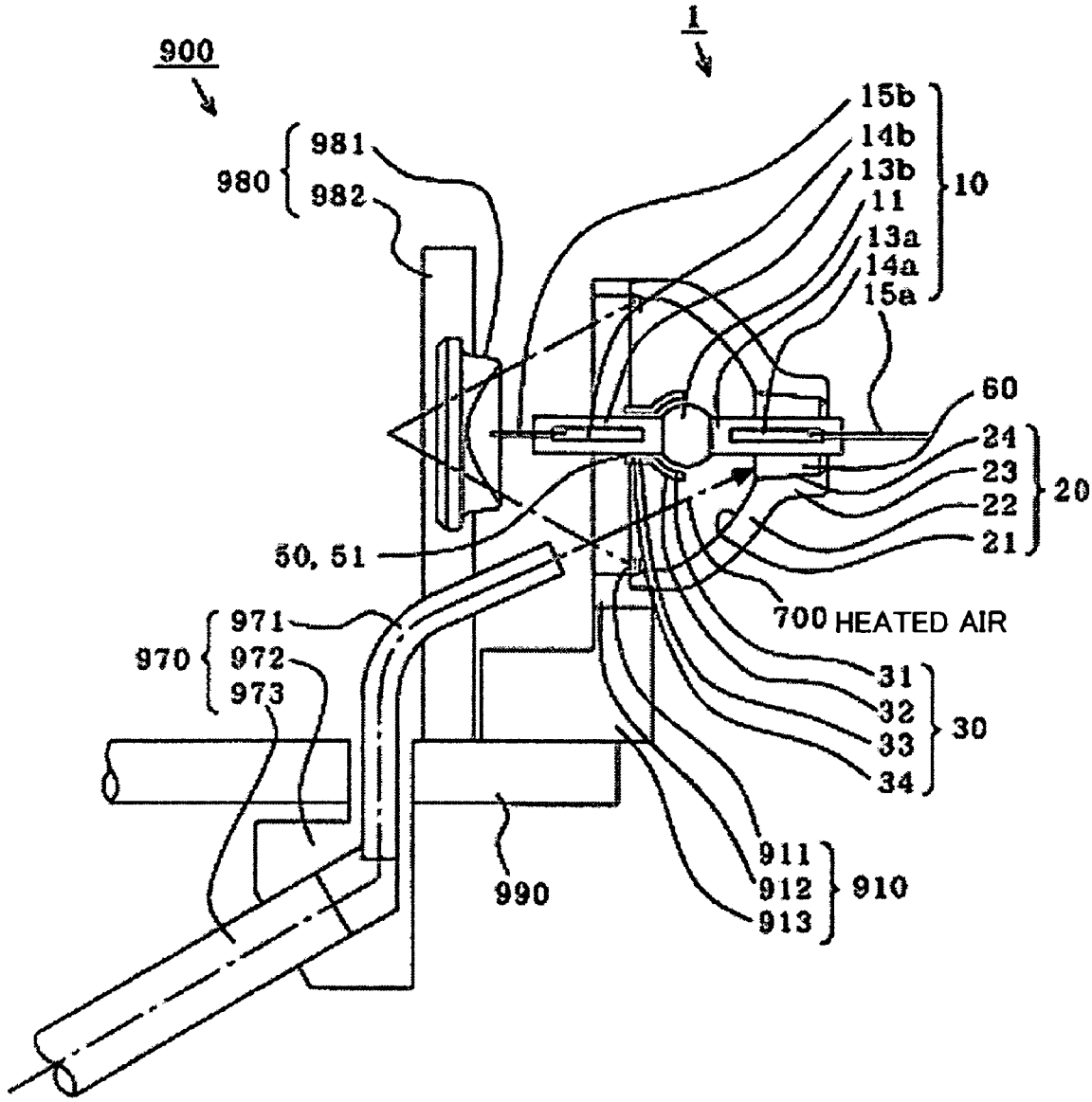
FIG. 10 is a schematic showing a heating and curing apparatus to carry out heating and curing for an inorganic adhesive in the example of the light source lamp manufacturing method according to the second exemplary embodiment of the invention.

FIG. 10 is a schematic showing a heating and curing apparatus 900 to carry out a heating and curing step for the inorganic adhesive 60 (Step 14) in the example of the light source lamp manufacturing method according to the second exemplary embodiment of the invention. In FIG. 10, the heating and curing apparatus 900 has: an apparatus base 990; a reflector holding part 910 to hold the reflector 20 of the light source lamp 1 in position; a light-emitting portion-holding part (not shown) to dispose the light-emitting portion 10 of the light source lamp 1 in position; a heated air blowoff part 970 to blow off a heated air against the inorganic adhesive 60 of the light source lamp 1; and a parallelizing lens-holding part 980 to collimate and leading out the emission light from the light source lamp 1 for the purpose of checking relative positions of the arc tube 10 and reflector 20.

The reflector holding part 910 has: a positioning ring 911 which the end of the reflector 20 is to abut against; a reflector-grasping claw 912 to grasp the reflector 20 positioned by the positioning ring 911; and a ring supporting base 913 to attach the positioning ring 911 to the apparatus base 990.

The heated air blowoff part 970 has: a heated air nozzle 971 to blow off a heated air against the inorganic adhesive 60 of the light source lamp 1 held by the reflector holding part 910; a heated air line 973 connected with the heated air nozzle 971; and a nozzle-supporting base 972 to support the heated air nozzle 971 and/or the heated air line 973.

The parallelizing lens-holding part 980 has a parallelizing lens 981 to collimate an emission light from the light source lamp 1 and a parallelizing lens-supporting base 982. Whether or not the relative positions of the arc tube 10 and reflector 20 are optimal is judged by a detector (not shown) based on the light led out of the parallelizing lens 981, and then the positioning of the arc tube 10 relative to the reflector 20 is performed.

Therefore, the inorganic adhesive 60 can be cured by blowing off a heated air against the inorganic adhesive 60 and/or turning on the halogen lamp, in the condition where the reflector 20 and light-emitting portion 10 of the light source lamp 1 are held in position respectively.

Also, a halogen lamp (not shown) may be placed in a location on the side opposite to the reflecting surface 21 of the reflector 20, specifically the backside thereof (on the right side in FIG. 10). Then, the curing of an uncured portion of the inorganic adhesive 60 on the side opposite to the reflecting surface 21 may be further pursued by turning on the halogen lamp and/or the arc tube 10 after a portion of the inorganic adhesive 60 at least on the side of the reflecting surface 21 has been cured by blowing off a heated air and/or turning on the halogen lamp.

The number of the heated air nozzles 971 to be attached is not limited to one. The heated air nozzles may be disposed at locations generally along the circumference of a circle, thereby making it possible to blow off the heated air 700 against the targeted locations on a surface of the inorganic adhesive 60 on the side of the reflecting surface 21. In this case, the surface of the inorganic adhesive 60 on the side of the reflecting surface 21 can be heated uniformly.

A swing mechanism to swing the heated air nozzle 971 may be provided, thereby to allow the heated air 700 to be repeatedly blown off against a wider range in the surface of the inorganic adhesive 60 on the side of the reflecting surface 21.

Further, the positioning ring 911 may be arranged so that the ring can rotate with the center of the positioning ring 911 (coincident with the center of the reflector 20) as its center of rotation when the light-emitting portion-holding part (not shown) is attached on the positioning ring 911 of the reflector holding part 910. In this case, the heated air 700 is to be blown off against the surface of the inorganic adhesive 60 on the side of the reflecting surface 21 further uniformly.

However, the heating and curing apparatus to carry out the heating and curing step (Step 14) is not limited like this. For example, the curing of the inorganic adhesive 60 on the side of the reflecting surface 21 may be done by turning on a halogen lamp placed separately. In this case, the placement of the heated air blowoff part 970 may be omitted.

Third Exemplary Embodiment

Structure of Projector

Figure 6:
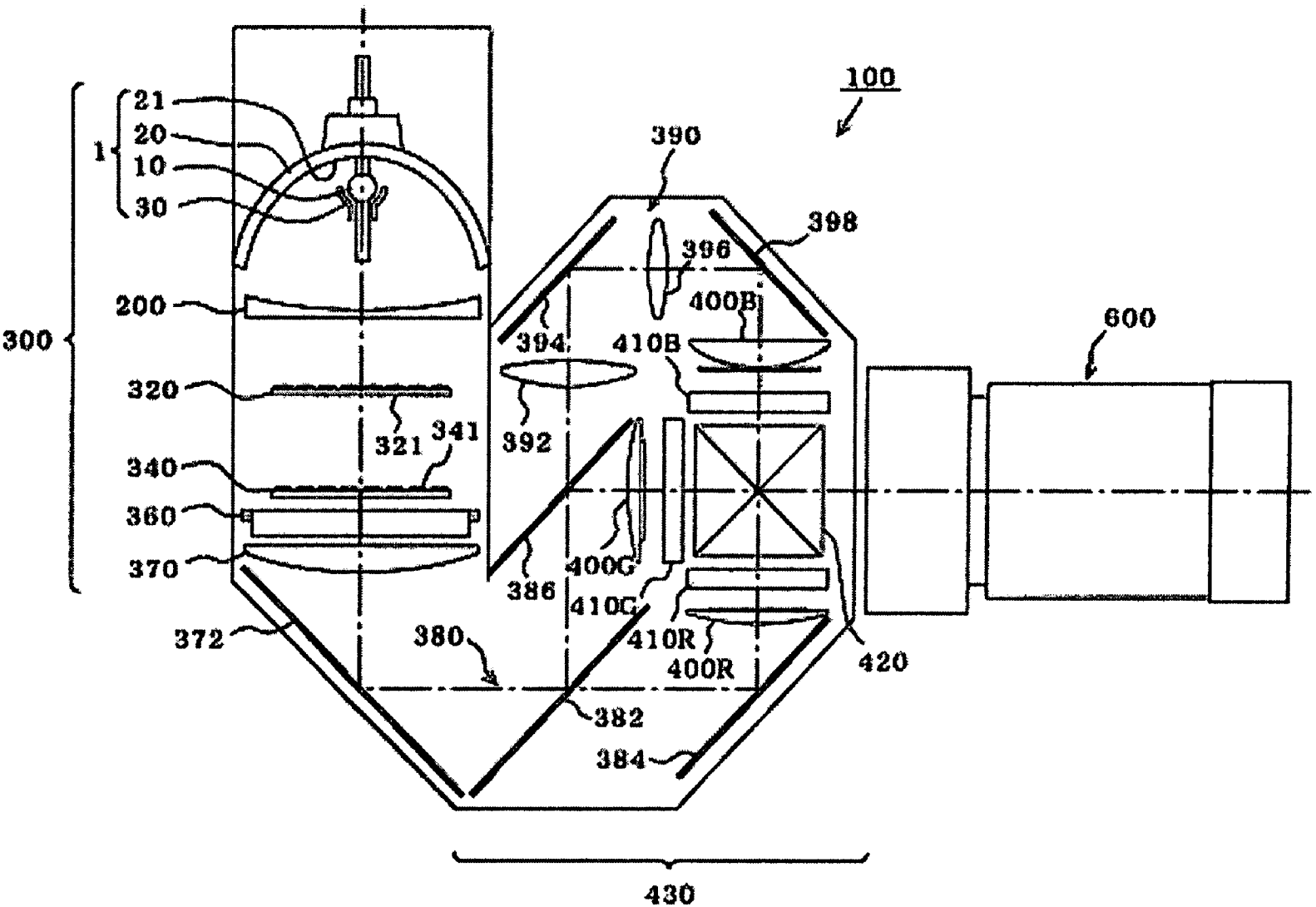
FIG. 6 is a schematic of a projector according to the third exemplary embodiment of the invention.

FIG. 6 is a schematic of a projector 100 according to the third exemplary embodiment of the invention. As shown in FIG. 6, the projector 100 includes: an illumination system 300; a color light separation optical system 380; a relay optical system 390; liquid crystal panels 410R, 410G, and 410B; a cross dichroic prism 420; and a projector lens 600.

Moreover, the light source lamp 1, which has been described in connection with the first exemplary embodiment, is placed in the illumination system 300. The effect of the projector 100 will be described below.

The illumination system 300 is an optical integration system to illuminate image-forming regions of the liquid crystal panels 410R, 410G, 410B substantially uniformly. The illumination system 300 includes: the light source lamp 1; a first lens array 320; a second lens array 340; a polarization conversion element array 360; and a superimposing lens 370.

First, the emission light from the arc tube 10 of the light source lamp 1 is reflected by the reflector 20 directly or after being reflected by the auxiliary mirror 30 once, and goes into the concave lens 200. As a result, the light is so regulated that its traveling direction is made substantially parallel with the optical axis of the illumination system 300.

The collimated light enters small lenses 321 of the first lens array 320 and is divided into partial light beams corresponding to the small lenses 321 in number. Further, the partial light beams, which have left the first lens array 320, enter the second lens array 340 having small lenses 341 respectively corresponding to the small lenses 321.

Lights, which have traveled out of the second lens array 340, enter the polarization conversion element array 360 for making a conversion into linearly polarized lights of the same kind in the polarized direction of the light. Then, the partial light beams, which have been made the same polarized direction by the polarization conversion element array 360, go into the superimposing lens 370, where the beams are regulated so that partial light beams incident on the liquid crystal panels 410R, 410G, 410B are superposed together on a corresponding panel plane.

The light which has left the superimposing lens 370 is reflected off the reflection mirror 372, and then enters the color light separation optical system 380. The color light separation optical system 380 is an optical system which serves to separate the light emitted from the illumination system 300 into three color lights of red, green, and blue. The color light separation optical system 380 includes first and second dichroic mirrors 382, 386 and a reflection mirror 384.

The first dichroic mirror 382 allows red color light components of the lights emitted from the superimposing lens 370 to transmit and reflects blue and green color light components. Thus, the red color light components transmit the first dichroic mirror 382, undergo a reflection by the reflection mirror 384, pass through the field lens 400R, and reach the liquid crystal panel 410R for red color light. Of the blue and green color light components reflected by the first dichroic mirror 382, the green color light components are reflected by the second dichroic mirror 386, pass through the field lens 400G, and reach the liquid crystal panel 410G for green color light.

The blue color light components transmit the second dichroic mirror 386 and enter the relay optical system 390. The relay optical system 390 is an optical system having the function of guiding the blue color light, which has transmitted the dichroic mirror 386 of the color light separation optical system 380, to the liquid crystal panel 410B. The relay optical system 390 includes an incident-side lens 392; a relay lens 396; and reflection mirrors 394 and 398.

The blue color light components pass through the incident-side lens 392, reflection mirror 394, relay lens 396, reflection mirror 398, and field lens 400B, and then reach the liquid crystal panel 410B for blue color light.

Incidentally, the reason why the relay optical system 390 is used for blue color light is that it is necessary to prevent the reduction in the efficiency of use of light owing to the divergence of light, etc. because the length of the optical path of blue color light is longer than that of the other color lights. The reason is to transmit the partial light beam incident on the incident-side lens 392 to the field lens 400B as it is. While the relay optical system 390 was intended herein that a blue color light of three color lights travels therethrough, the system 390 may be arranged so that another color light such as a red color travels therethrough.

Subsequently, the three liquid crystal panels 410R, 410G, 410B modulate entered color lights according to a given image information to form images of the colors. On the light-input and light-output sides of each of the liquid crystal panels 410R, 410G, 410B, polarizing plates are provided typically.

Next, the modulated color lights emitted from the liquid crystal panels 410R, 410G, 410B enter the cross dichroic prism 420 used as a color light-combining system to combine the modulated lights to form a color image. The cross dichroic prism 420 has four right-angle prisms, and a dielectric multilayer film to reflect red color light and a dielectric multilayer film to reflect blue color light, in which the multilayer films are formed on interfaces of the four right-angle prisms in a substantial X form. The dielectric multilayer films combine the three color lights.

Then, the color image emitted from the cross dichroic prism 420 is enlarged and projected onto a screen by the projector lens 600.

Since the projector 100 includes the light source lamp 1, a projected image of good quality will be provided.

When the light source lamp 1 is manufactured, the auxiliary mirror 30 is fixed to the arc tube 10 by heating and curing the inorganic adhesive 50 injected into the neck portion gap 51 from the side nearer to the light-emitting portion 11 (i.e. the side nearer to the sealing portion 13*a*) so that the light-emitting portion 11 of the arc tube 10 and the auxiliary reflecting surface 31 of the auxiliary mirror 30 are kept clean. This assures the light emission efficiency of the arc tube 10 and the reflection efficiency of the auxiliary mirror 30, and consequently an increased brightness of the light source lamp 1 and uniform illumination are ensured.

Even when the projector 100 includes the light source lamp 2 instead of the light source lamp 1, the same effect and advantage can be obtained.

The projector 100 of an exemplary aspect of the invention is not limited to the form described above, and it may be embodied in various forms within a scope not departing from the subject matter of the invention. For example, the following modification may be made.

While in the forementioned form, two lens arrays 320 and 340 were used to divide a light from the light source lamp 1 or 2 into partial light beams, exemplary aspects of the invention are also applicable to a projector which does not incorporate such lens arrays.

While the exemplary embodiments have been described taking a projector with transmission type liquid crystal panels as an example, the invention is not so limited. Exemplary aspects of the invention may also be applicable to a projector which incorporates reflection type liquid crystal panels.

In the case of a projector with reflection type liquid crystal panels, the projector can be configured by only liquid crystal panels and therefore a pair of polarizing plates is not needed. Also, in a projector with reflection type liquid crystal panels, a cross dichroic prism can be used as a color light separating means to separate an illuminated light into color lights of red, green, and blue, while it can be used as a color light combining means to recombine modulated lights of three colors to emit the resultant light in a common direction.

Also, a dichroic prism composed of a combination of triangular or rectangular dichroic prisms can be used instead of a cross dichroic prism. Even when the invention is applied to a projector with reflection type liquid crystal panels, almost the same advantage can be obtained as that provided by a projector with transmission type liquid crystal panels.

Also, while exemplary aspects of the invention have been described taking as an example a projector with three liquid crystal panels used as modulators, exemplary aspects of the invention can be also applied to a projector so arranged that it uses one, two, or four liquid crystal panels or more.

An optical modulator to modulate incident light to produce an image is not limited to a liquid crystal panel, and it may be, for example, a device with micromirrors. Further, the light source lamp of an exemplary aspect of the invention is applicable to any of a front projection type projector which projects an image from a direction to observe a projection plane and a rear projection type projector which projects an image from a direction opposite to a direction to observe a projection plane.

INDUSTRIAL APPLICABILITY

As described above, the light source lamp of an exemplary aspect of the invention and its manufacturing method can be widely utilized as a light source lamp for projectors or other various kinds of optical devices and as its manufacturing method.

What is claimed is:

1. A method of manufacturing a light source lamp having an arc tube including a light-emitting portion and a pair of sealing portions extending on both sides of the light-emitting portion, a reflector fixed to one sealing portion to reflect an emission light emitted from the light-emitting portion, and an auxiliary mirror fixed to the other sealing portion to reflect an emission light emitted from the light-emitting portion toward the reflector, the method comprising:

setting a light-reflecting surface of the auxiliary mirror so as to face the light-emitting portion and injecting an adhesive into a gap between the auxiliary mirror and the other sealing portion;

heating and curing the adhesive from a side nearer to the light-emitting portion of the arc tube so that the vapor and adhesive particles from the adhesive are scattered in a direction opposite to the light-emitting portion; and attaching the reflector to the arc tube with the auxiliary mirror fixed thereto.

2. The method of manufacturing a light source lamp of claim 1, the heating and curing including blowing off a heated air against the adhesive from the side nearer to the light-emitting portion of the arc tube.

3. The method of manufacturing a light source lamp of claim 1, the heating and curing including irradiating the adhesive with a light from the side nearer to the light-emitting portion of the arc tube.

4. A method of manufacturing a light source lamp having an arc tube including a light-emitting portion and a pair of sealing portions extending on both sides of the light-emitting portion, and a reflector fixed to one sealing portion to reflect an emission light emitted from the light-emitting portion, the method comprising:

injecting an adhesive into a gap between the one sealing portion and the reflector; and heating and curing the adhesive from a side nearer to the light-emitting portion of the arc tube so that the vapor and adhesive particles from the adhesive are scattered in a direction opposite to the light-emitting portion.

5. The method of manufacturing a light source lamp of claim 4 the heating and curing including blowing off a heated air against the adhesive from the side nearer to the light-emitting portion of the arc tube.

6. The method of manufacturing a light source lamp of claim 4, the heating and curing including heating and curing at least a portion of the adhesive nearer to the light-emitting portion of the arc tube from the side nearer to the light-emitting portion, and heating and curing the remaining portion of the adhesive from a side opposite to the side nearer to the light-emitting portion.

7. A light source lamp, comprising:

an arc tube including a light-emitting portion and a pair of sealing portions extending on both sides of the light-emitting portion;

a reflector fixed to one sealing portion to reflect an emission light emitted from the light-emitting portion; and an auxiliary mirror fixed to the other sealing portion by an adhesive and having a light-reflecting surface to reflect an emission light emitted from the light-emitting portion toward the reflector; wherein the adhesive particles do not adhere to the light-emitting portion of the arc tube and the light-reflecting surface of the auxiliary mirror during curing of the adhesive, the auxiliary mirror being fixed to the other sealing portion by setting the light-reflecting surface so as to face the light-emitting portion, injecting an adhesive into a gap between the auxiliary mirror and the other sealing portion, and heating and curing the adhesive from the side nearer to the light emitting portion of the arc tube.

8. The light source lamp of claim 7, the auxiliary mirror including a body portion having a light-reflecting surface, and a fixing neck portion adjacent to the body portion and used to fix the auxiliary mirror to said arc tube.

9. A projector, comprising:

an illumination system including the light source lamp of claim 7;

an optical modulator to produce an image by modulating a light emitted from the illumination system according to image information; and a projector lens to project the image.

10. The projector of claim 9, the auxiliary mirror including a body portion having a light-reflecting surface, and a fixing neck portion adjacent to the body portion and used to fix the auxiliary mirror to said arc tube.

11. A light source lamp, comprising:

an arc tube including a light-emitting portion and a pair of sealing portions extending on both sides of the light-emitting portion; and a reflector fixed to one sealing portion to reflect an emission light emitted from the light-emitting portion, wherein the adhesive particles do not adhere to the light-emitting portion of the arc tube and a light-reflecting surface of the reflector during curing of the adhesive, the reflector being fixed to the one sealing portion by injecting an adhesive into a gap between the reflector and the one sealing portion, and heating and curing the adhesive from a side nearer to the light-emitting portion of the arc tube.

12. The light source lamp of claim 11, further comprising:

an auxiliary mirror fixed to the other sealing portion of the pair of sealing portions and having a light-reflecting surface to reflect an emission light emitted from the light-emitting portion toward the reflector, the auxiliary mirror being fixed to the other sealing portion by setting the light-reflecting surface so as to face the light-emitting portion, injecting an adhesive into a gap between the auxiliary mirror and the other sealing portion, and heating and curing the adhesive from the side nearer to the light-emitting portion of the arc tube.

13. A projector, comprising:

an illumination system including the light source lamp of claim 11;

an optical modulator to produce an image by modulating a light emitted from the illumination system according to image information; and a projector lens to project the image.

14. The projector of claim 13, further comprising:

an auxiliary mirror fixed to the other sealing portion of the pair of sealing portions and having a light-reflecting surface to reflect an emission light emitted from the light-emitting portion toward the reflector, the auxiliary mirror being fixed to the other sealing portion by setting the light-reflecting surface so as to face the light-emitting portion, injecting an adhesive into a gap between the auxiliary mirror and the other sealing portion, and heating and curing the adhesive from the side nearer to the light-emitting portion of the arc tube.

* * * * *